United States Patent [19]

McWilliams

[11] Patent Number: 4,727,241

[45] Date of Patent: Feb. 23, 1988

[54] RADIANT ELECTRIC HEATERS INCORPORATING MICROPOROUS THERMAL INSULATION

[75] Inventor: Joseph A. McWilliams, Droitwich, United Kingdom

[73] Assignee: Micropore International Ltd., Droitwich, United Kingdom

[21] Appl. No.: 896,590

[22] Filed: Aug. 14, 1986

[30] Foreign Application Priority Data

Aug. 16, 1985 [GB] United Kingdom ..... 8520565

[51] Int. Cl.[4] ..... H05B 3/74

[52] U.S. Cl. ..... 219/460; 219/459; 219/464

[58] Field of Search ..... 219/457, 458, 459, 460, 219/461, 463, 464

[56] References Cited

U.S. PATENT DOCUMENTS

| | | | |
|---|---|---|---|
| 1,528,000 | 3/1925 | Tugendhat | 219/468 |
| 3,086,101 | 4/1963 | Scofield | 219/459 |
| 3,335,261 | 8/1967 | Siegla et al. | 219/468 |
| 3,612,827 | 10/1971 | Dills | 219/463 |
| 3,612,828 | 10/1971 | Siegla | 219/463 |
| 4,347,432 | 8/1982 | Gössler | 219/457 |
| 4,388,520 | 6/1983 | McWilliams | 219/457 |

FOREIGN PATENT DOCUMENTS

| | | |
|---|---|---|
| 0134090 | 3/1985 | European Pat. Off. . |
| 2809131 | 9/1979 | Fed. Rep. of Germany . |
| 3034495 | 3/1982 | Fed. Rep. of Germany . |
| 2149280 | 6/1985 | United Kingdom . |

*Primary Examiner*—E. A. Goldberg
*Assistant Examiner*—Teresa J. Walberg
*Attorney, Agent, or Firm*—Browdy and Neimark

[57] ABSTRACT

A radiant electric heater has a support which bears a layer of microporous thermal insulation material such as that sold under the registered trademark "Microtherm" with a heat transmissive cover spaced from the layer by a peripheral wall and heating elements positioned within an area defined by the peripheral wall and coiled around a plurality of quartz tubes. The quartz rods are urged against the layer of microporous thermal insulation material by the cover by way of the peripheral wall.

5 Claims, 7 Drawing Figures

RADIANT ELECTRIC HEATERS INCORPORATING MICROPOROUS THERMAL INSULATION

FIELD OF THE INVENTION

The present invention relates to radiant electric heaters which incorporate microporous thermal insulation material.

BACKGROUND OF THE INVENTION

Microporous thermal insulation materials are materials which have a lattice structure in which the average interstitial dimension is less than the mean free path of the molecules of air or other gas in which the material is arranged. This results in a thermal conductivity which is less than the molecular conductivity of air or other gas in which the material is used.

The lattice structure is created within a powder material by using a powder with very fine particles which adhere to each other in a chain-like formation. A suitable powder for providing this structure is a finely divided silica normally referred to as silica aerogel or pyrogenic silica.

A block of microporous thermal insulation material can be manufactured from such powders by applying pressure to the powder to compact the particles closely together so that a bond is created at the point of contact between adjacent particles. However, such a block is weak and brittle. Intimate mixing of a reinforcing fibre such as ceramic fibre with the powder before the application of pressure makes it possible to produce a stronger block, although such a block is still brittle and unable to withstand shocks if it is unsupported. An opacifying material such as powdered rutile, ilmenite or other materials having a high refractive index may be added to provide infra-red opacification.

DESCRIPTION OF PRIOR ART

Because of this structural weakness, until now it has been conventional to use microporous thermal insulation material in radiant electric heaters in cases where the insulation material is supported by a metal plate, for example it may be pressed into a metal dish and can, therefore, only be used in a horizontal position with the insulation material resting on top of the metal base.

OBJECT OF THE INVENTION

It is an object of the present invention to provide a radiant electric heater incorporating microporous thermal insulation in which the microprous thermal insulation is not supported solely by the base of the heater.

SUMMARY OF THE INVENTION

According to the present invention there is provided a radiant electric heater which comprises a layer of microporous thermal insulation material, a support for the insulation material, a heat transmissive cover, a heating element arranged between the cover and the layer of microporous thermal insulation material, a peripheral wall of insulation material extending around the heating element, and means for transmitting a biasing force from the heat transmissive cover to the layer of microporous thermal insulation material so as to urge the layer within an area defined by the peripheral wall towards the support.

The heating element may be confined within a heat transmissive tube, which tube is urged against the microporous insulation material by the cover.

The layer of microporous insulation material may be formed with protrusions which bear against the cover.

Alternatively, the heating element may be in the form of a bare wire which is arranged in grooves formed in the layer of microporous thermal insulation material, the portions of the surface of the layer between the grooves bearing against the cover.

In a further embodiment, the heating element is confined within a plurality of heat transmissive tubes, which tubes are urged against the layer of microporous thermal insulation material by the cover by way of the peripheral wall. Alternatively, the heating elements may be coiled around a plurality of heat transmissive rods, which rods are urged against the layer of microporous thermal insulation material by the cover by way of the peripheral wall.

For a better understanding of the present invention and to show more clearly how it may be carried into effect reference will now be made to the accompanying drawings in which:

DESCRIPTION OF PREFERRED EMBODIMENTS

Figure 1:
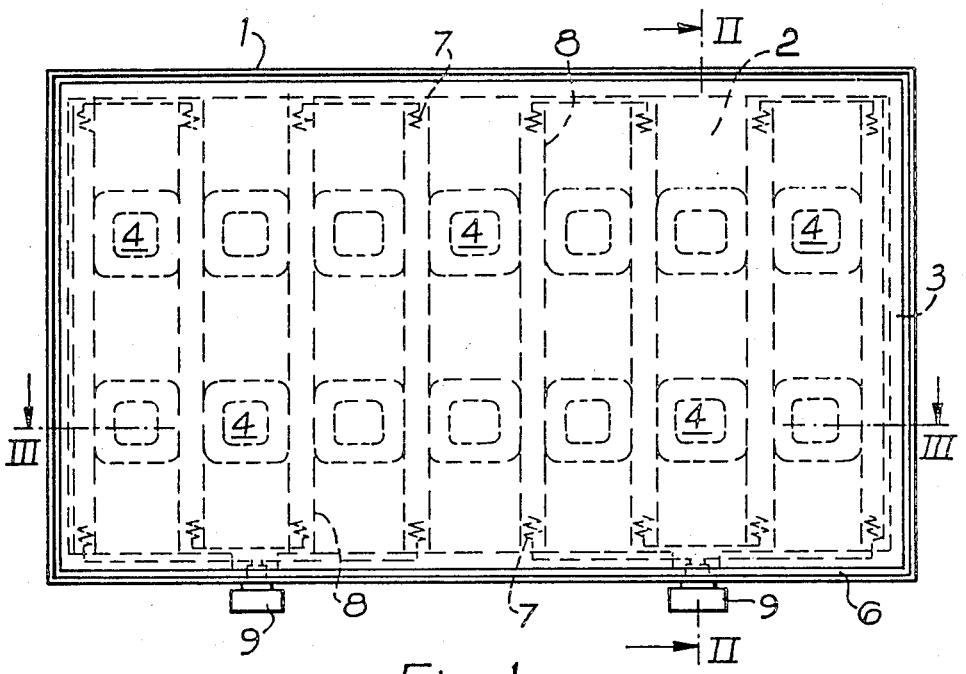
FIG. 1 is a plan view of one embodiment of a radiant electrical heater according to the present invention.
Figure 2:
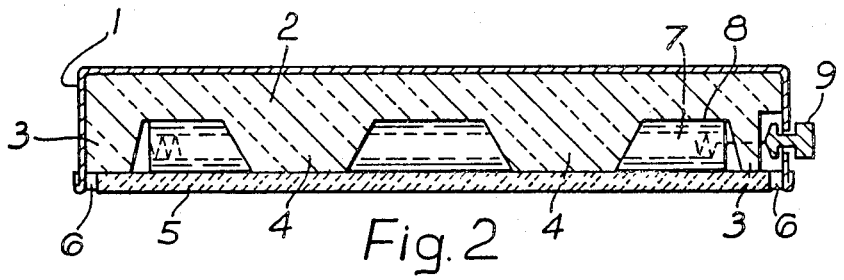
FIG. 2 is a sectional view taken along the line 11—11 in FIG. 1.
Figure 3:
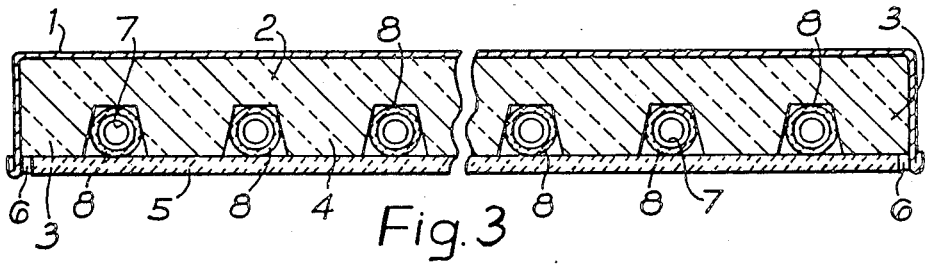
FIG. 3 is a sectional view taken along the line 111—111 in FIG. 1.

FIGS. 1, 2 and 3 show a radiant electric heater which comprises a support in the form of a metal dish 1 containing a base layer 2 of microporous thermal insulation material such as that sold under the registered trade mark "Microtherm". The microporous thermal insulation material is formed with a peripheral wall 3 and with a number of projections in the form of raised areas 4 which support a cover of high-temperature resistant glass 5. The glass 5 is sealed into the metal dish 1 by a suitable adhesive or sealant compound 6.

Two heating elements 7, which are coiled along most of their length, are arranged on the base layer 2 and are confined within tubes 8 made, for example, of silica or quartz glass. The heating elements are connected with a source of electrical power (now shown) by way of terminal blocks 9. The tubes 7 are sandwiched between the glass cover 5 and the base layer 2 and serve to support the base layer.

With this construction of radiant heater, we have found that the heater can be used in any orientation ranging from a horizontal position with the glass cover uppermost to an inverted position with the glass cover facing downwards while still maintaining adequate support for both the heating element and the microporous thermal insulation.

In other embodiments, not illustrated, the peripheral wall 3 is replaced by a wall made of ceramic fibre and the raised areas 4 are omitted or replaced by areas of ceramic fibre. However, the base layer 2 is still supported by the tubes 7 which are urged against the base layer by the glass cover 5.

In another embodiment which is not illustrated, the heating element runs in a groove formed in the microporous thermal insulation and is in the form of a bare coiled wire, that is not confined within a tube, and the land areas of the microporous thermal insulation between the grooves lie against the underside of the glass cover. However, in such an embodiment it is necessary to use glass of a high purity for the cover so that the glass does not become electrically conductive at high temperature.

Figure 4:
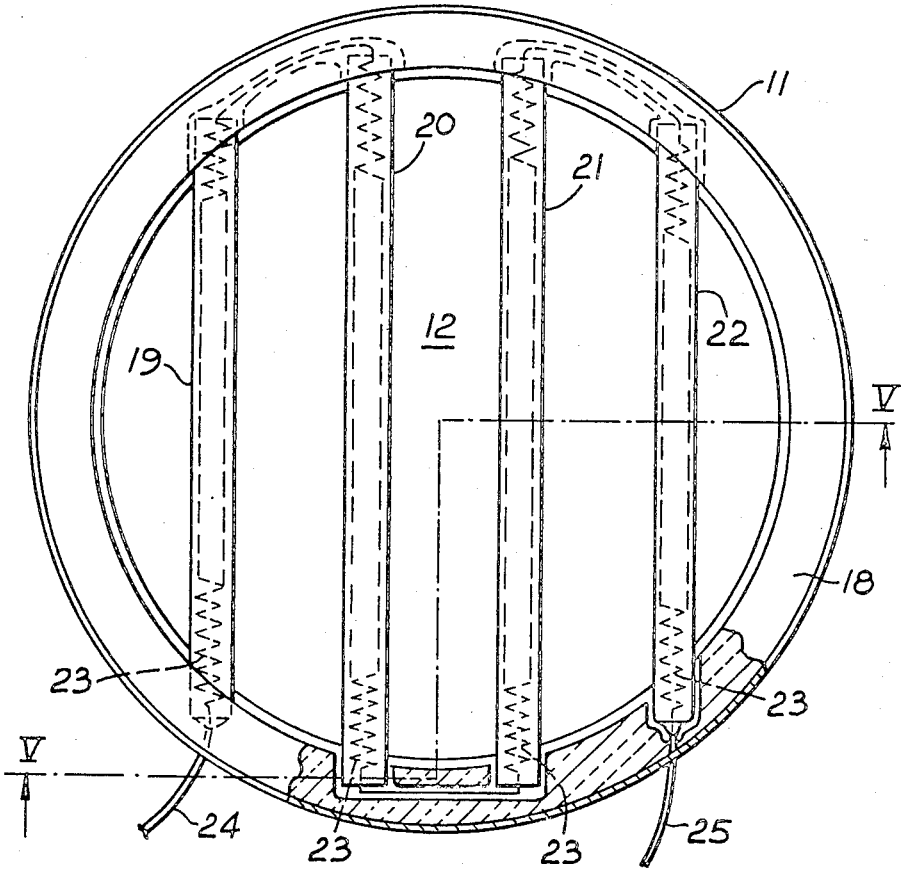
FIG. 4 is a plan view of a second embodiment of a radiant electrical heater according to the present invention.
Figure 5:
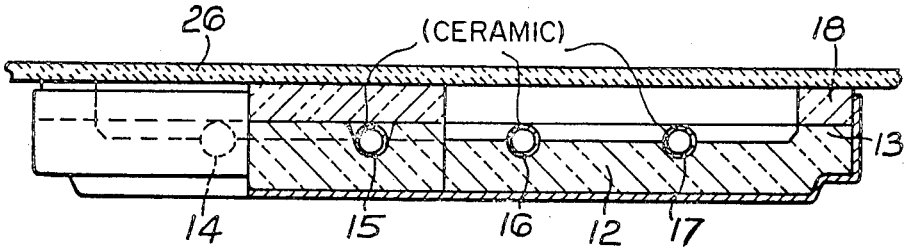
FIG. 5 is a sectional view taken along the line V—V in FIG. 4.

FIGS. 4 and 5 show a radiant electric heater which comprises a support in the form of a metal dish 11 containing a base layer 12 of microporous thermal insulation material such as that sold under the registered trade mark "Microtherm". The microporous material is formed with a peripheral lip 13 and with a number of parallel grooves 14,15,16,17. A peripheral wall 18 of ceramic fibre is supported on the peripheral lip 13.

Quartz tubes 19,20,21,22 are arranged in the grooves 14–17 in the microporous material and extend beneath the peripheral wall 18. In use, the upper surface (as shown in FIG. 5) of the peripheral wall 18 is urged against a heat transparent sheet 26 such as glass ceramic or quartz which in turn urges the peripheral wall against the quartz tubes 19–22 and thus urges the glass tubes against the base layer 12 of microporous thermal insulation material.

A heating element 23 in the form of a coil of bare resistance wire is located within the quartz tubes 19–22. Those portions of the heating element which are not within the quartz tubes are straightened so as to minimise the generation of heat externally of the quartz tubes. Electrical power is supplied to the heating element 23 by way of connecting leads 24, 25.

Figure 6:
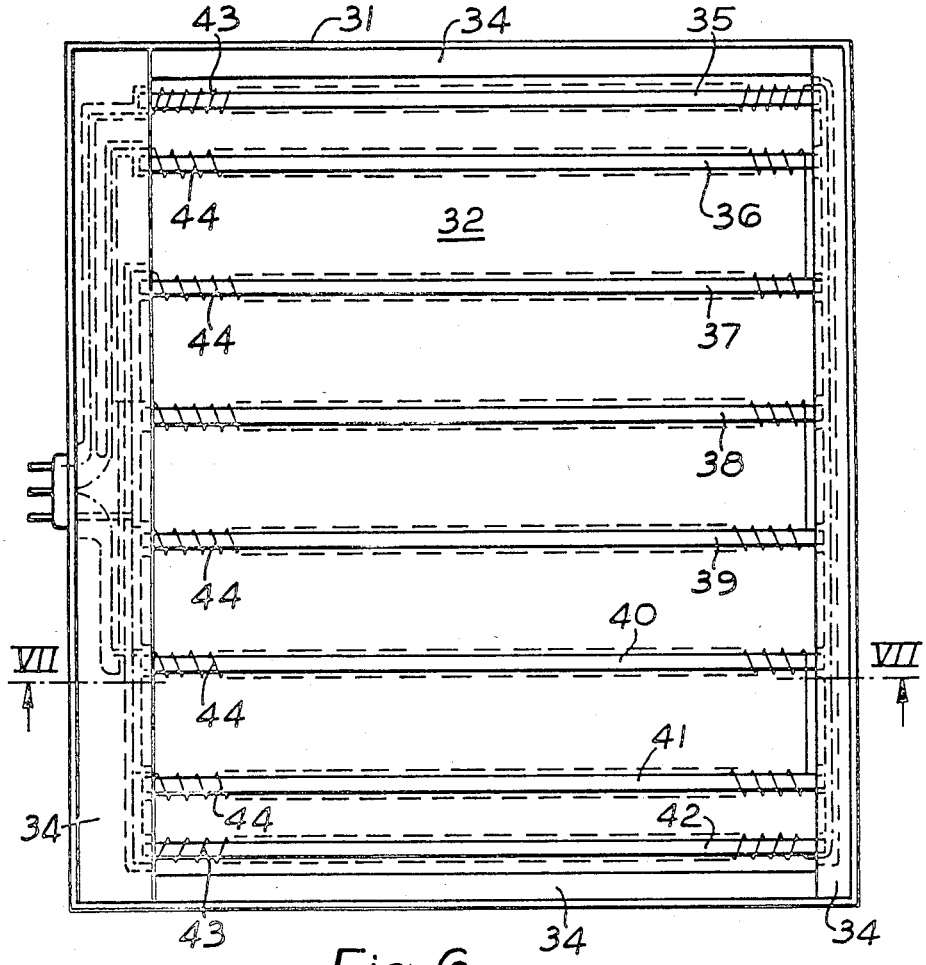
FIG. 6 is a plan view of a third embodiment of a radiant electrical heater according to the present invention.
Figure 7:
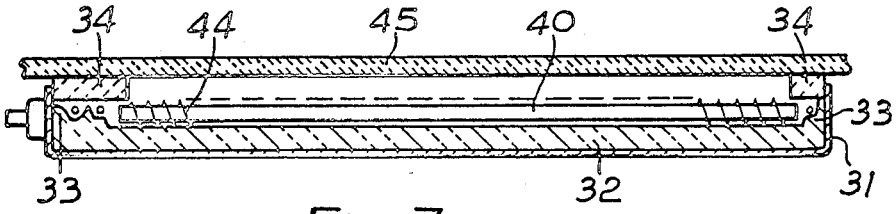
FIG. 7 is a sectional view taken along the line VII—VII in FIG. 6.

FIGS. 6 and 7 show a radiant electric heater which comprises a support in the form of a metal dish 31 containing a base layer 32 of microporous thermal insulation material such as that sold under the registered trade mark "Microtherm". The microporous material is formed with a peripheral lip 33 which is provided with a number of grooves for the passage of the heating element as will be discussed in more detail hereinafter. A peripheral wall 34 of ceramic fibre material is supported on the peripheral lip 33.

Quartz rods 35–42 extend across the base layer 32 and extend into the peripheral lip 33 beneath the peripheral wall 34. In use, the upper surface (as shown in FIG. 7) of the peripheral wall 34 is urged against a heat transparent sheet 45, for example of glass ceramic or quartz, which in turn urges the peripheral wall against the quartz rods 35–42 and thus urges the quartz rods against the base layer 32 of microporous thermal insulation material. Heating elements 43 in the form of coils of bare resistance wire are wound around the outer quartz rods 35,42. The heating elements 43 may be rated at 350 watts each and are electrically connected in series. Heating elements 44, also in the form of coils of bare resistance wire are wound around the inner quartz rods 36–41. The heating elements 44 may be rated at 300 watts each and adjacent elements are electrically connected in series so as to form three elements rated at 600 watts which are electrically connected in parallel. The heating elements 43,44 may be operated independently or in combination.

Those portions of the heating elements 43,44 which are located between the quartz rods and the base layer are urged against the base layer which assists in ensuring the stability of the heating elements.

I claim:

1. A radiant electric heater which comprises:

a layer of microporous thermal insulation material;

a support for the insulation material;

a radiation transmissive cover;

a heating element arranged between the cover and the layer of microporous thermal insulation material;

a peripheral wall of insulation material extending around the heating element;

radiation transmissive supporting means for supporting the heating element within an area defined by the peripheral wall; and means for transmitting a biasing force from the radiation transmissive cover to the layer of microporous thermal insulation material so as to urge the layer within an area defined by the peripheral wall towards the support.

2. A radiant electric heater according to claim 1, wherein the radiation transmissive supporting means comprises a radiation transmissive tube within which the heating element is confined, which tube is urged against the microporous insulation material by the cover.

3. A radiant electric heater according to claim 1, wherein the layer of microporous insulation material is formed with protrusions which bear against the cover.

4. A radiant heater according to claim 1, wherein the radiation transmissive supporting means comprises a plurality of radiation transmissive tubes within which the heating element is confined, which tubes are urged against the layer of microporous thermal insulation material by the cover by way of the peripheral wall.

5. A radiant electric heater according to claim 1, wherein the radiation transmissive supporting means comprises a plurality of radiation transmissive rods, the heating elements being coiled around the radiation transmissive rods, which rods are urged against the layer of microporous thermal insulation material by the cover by way of the peripheral wall.

* * * * *